US007669343B2

(12) United States Patent
Reynolds

(10) Patent No.: US 7,669,343 B2
(45) Date of Patent: Mar. 2, 2010

(54) ADJUSTABLE GABLE END LINE PULLER

(75) Inventor: Dennis D. Reynolds, 12 West Dr., Greenville, PA (US) 16125

(73) Assignee: Dennis D. Reynolds, Greenville, PA (US)

( * ) Notice: Subject to any disclaimer, the term of this patent is extended or adjusted under 35 U.S.C. 154(b) by 173 days.

(21) Appl. No.: 11/960,953

(22) Filed: Dec. 20, 2007

(65) Prior Publication Data

US 2009/0158561 A1 Jun. 25, 2009

(51) Int. Cl.
*E04G 21/18* (2006.01)
*G01C 15/10* (2006.01)

(52) U.S. Cl. ..... 33/408; 33/1 LE; 33/407; 52/749.13

(58) Field of Classification Search ..... 33/1 LE, 33/404–410, 413, 416, 494, 196, 197, 518, 33/339; 52/747.12, 749.1, 749.11–749.13, 52/DIG. 1

See application file for complete search history.

(56) References Cited

U.S. PATENT DOCUMENTS

| | | | | | |
|---|---|---|---|---|---|
| 2,140,714 | A * | 12/1938 | Palmer | 33/494 |
| 2,286,669 | A * | 6/1942 | Carr | 33/408 |
| 2,858,613 | A * | 11/1958 | Best | 33/407 |
| 2,881,532 | A * | 4/1959 | Boykin | 33/375 |
| 2,991,557 | A * | 7/1961 | Bongiovanni | 33/407 |
| 3,440,728 | A * | 4/1969 | Hackworth | 33/410 |
| 3,571,931 | A * | 3/1971 | Williams | 33/407 |
| 4,970,797 | A * | 11/1990 | Sarasin | 33/494 |
| 5,129,150 | A * | 7/1992 | Sorensen | 33/408 |
| 5,392,523 | A * | 2/1995 | Hurt | 33/408 |
| 5,964,042 | A * | 10/1999 | Carper | 33/407 |

* cited by examiner

*Primary Examiner*—Amy Cohen Johnson
(74) *Attorney, Agent, or Firm*—Ference & Associates LLC

(57) ABSTRACT

An improved adjustable gable end line puller is disclosed. A method for using the improved adjustable gable end line puller is also disclosed.

5 Claims, 3 Drawing Sheets

FIG.3
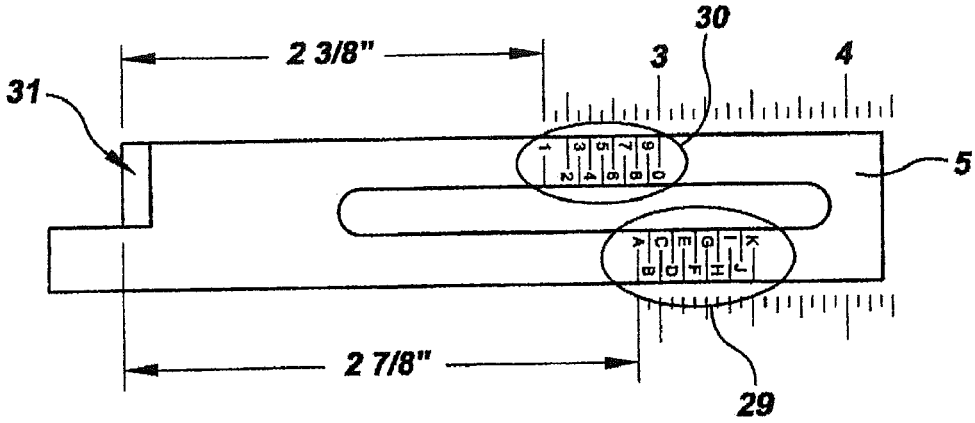
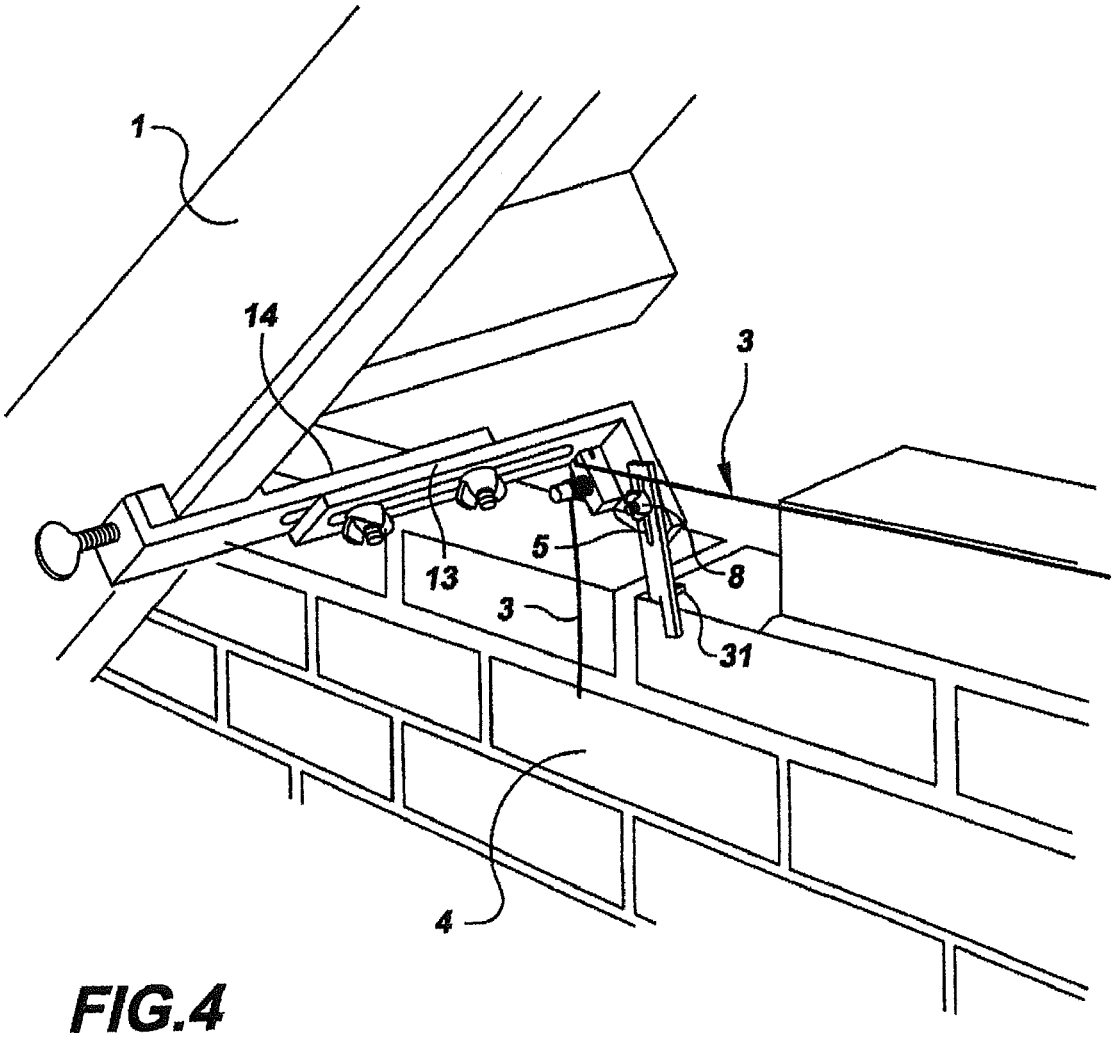
FIG.4

ADJUSTABLE GABLE END LINE PULLER

FIELD OF THE INVENTION

The present invention relates to an adjustable gable line puller device for brick masons. More specifically, the invention relates to a gable line puller that may be adjusted to clamp to any size roof overhang, holding a leveling line while a bricked-in gable is being built.

BACKGROUND OF THE INVENTION

The majority if not all houses require the construction of a bricked-in-gable under the roof. In constructing such gables, it is common practice to use a guide line suspended above the bricks that are being mortared into place under the gable. By following the guide line, the brick mason is assured that the stacked bricks and mortar remain even and level as the stack is built up even with the guide line suspended under the gable. Over the years, many devices have been utilized to suspend this guide line. Such a device is commonly referred to as a mason's guide line holder. In a classic arrangement for such a device, a pair of clamps suitable for holding a suspended line are attached to opposite ends of the gable face boards under the roof.

Over the years, various improvements have been made to the classic arrangement with respect to having to un-fasten and move, and re-set and re-fasten the pair of clamps as the stack of bricks becomes taller.

For example, U.S. Pat. No. 3,571,931 (Williams) uses a pair of clamps suitable for holding a mason's guide line and can be affixed to the gable face boards on the opposite sides of the roof. The problem is that the clamps must be adjusted and moved over and over and they are attached at the gable face boards farthest apart. Constructing a bricked-in-gable under a large roof overhang becomes quite time consuming and labor intensive because of the all the un-fastening, re-fastening, and adjustment of the clamps and guide line.

Obviously, having to move the clamps and re-adjust and re-fasten them takes time and creates an inefficiency in the task of building a bricked-in-gable. U.S. Pat. No. 5,964,042 (Carper) shows a device for holding a mason's guide line that utilizes a pair of clamps and a pair of angle irons. The angle irons are attached to the underside of the gable and the clamps are slid up and down the angle irons and provide an alternative clamping surface and trackway. Unlike the present invention, when the gable overhang is greater than 4.5 inches, this device requires that angle irons be affixed to the underside of the gable by screwing or nailing the angle irons under the gable, thus adding additional labor to the task of building a bricked-in-gable. Also, additional expense is added to the manufacture and ultimate purchase price of the device because additional metal and fabrication must take place to produce the appropriate angle irons to be used with the clamps.

Accordingly, the present invention describes an adjustable gable end line puller that solves all of the above problems.

SUMMARY OF THE INVENTION

The present invention broadly contemplates an adjustable gable end line puller comprising a pair of gable clamps, each clamp including: two horizontal members capable of telescopically extending and contracting from each other to accommodate roof overhangs; a fastener for attaching said gable clamp to a fascia board underneath the gable end of a roof, a fastener for holding a mason's guide line to said clamp; and a gap setting member for maintaining the appropriate width for the brick and mortar, said gap setting member pivotally and slidably mounted to the clamp; and a mason's guide line.

The present invention also contemplates a method for building a bricked-in-gable, comprising the steps of: attaching a clamp including: two horizontal members capable of telescopically extending and contracting from each other to accommodate roof overhangs; a fastener for attaching said gable clamp to a fascia board underneath the gable end of a roof, a fastener for holding a mason's guide line to said clamp; and a gap setting member for maintaining the appropriate width for the brick and mortar, said gap setting member pivotally and slidably mounted to the clamp; and a mason's guide line to the right most fascia board underneath the gable end of the roof, attaching an identically constructed clamp to the left most fascia board underneath the gable end of the roof, telescopically extending or contracting said horizontal members to accommodate the roof overhand; extending or contracting said gap setting member to the appropriate extension and angle for the width of the brick and mortar; attaching one end of a mason's guide line to the clamp attached to left most fascia board; attaching the other end of the mason's guide line to the clamp attached to the right most fascia board; and laying a row of bricks and mortar between the suspended mason's guide line and the stop fin of the gap setting member.

For a better understanding of the present invention, together with other and further features and advantages thereof, reference is made to the following description, taken in conjunction with the accompanying drawings, and the scope of the invention will be pointed out in the appended claims.

BRIEF DESCRIPTION OF THE DRAWINGS

FIG. 3 is a top view of the gap setting member of the adjustable gable end line puller described in the invention.

FIG. 4. is a contextual view of the adjustable gable end line puller described in the invention.

DESCRIPTION OF THE PREFERRED EMBODIMENTS

Figure 1:
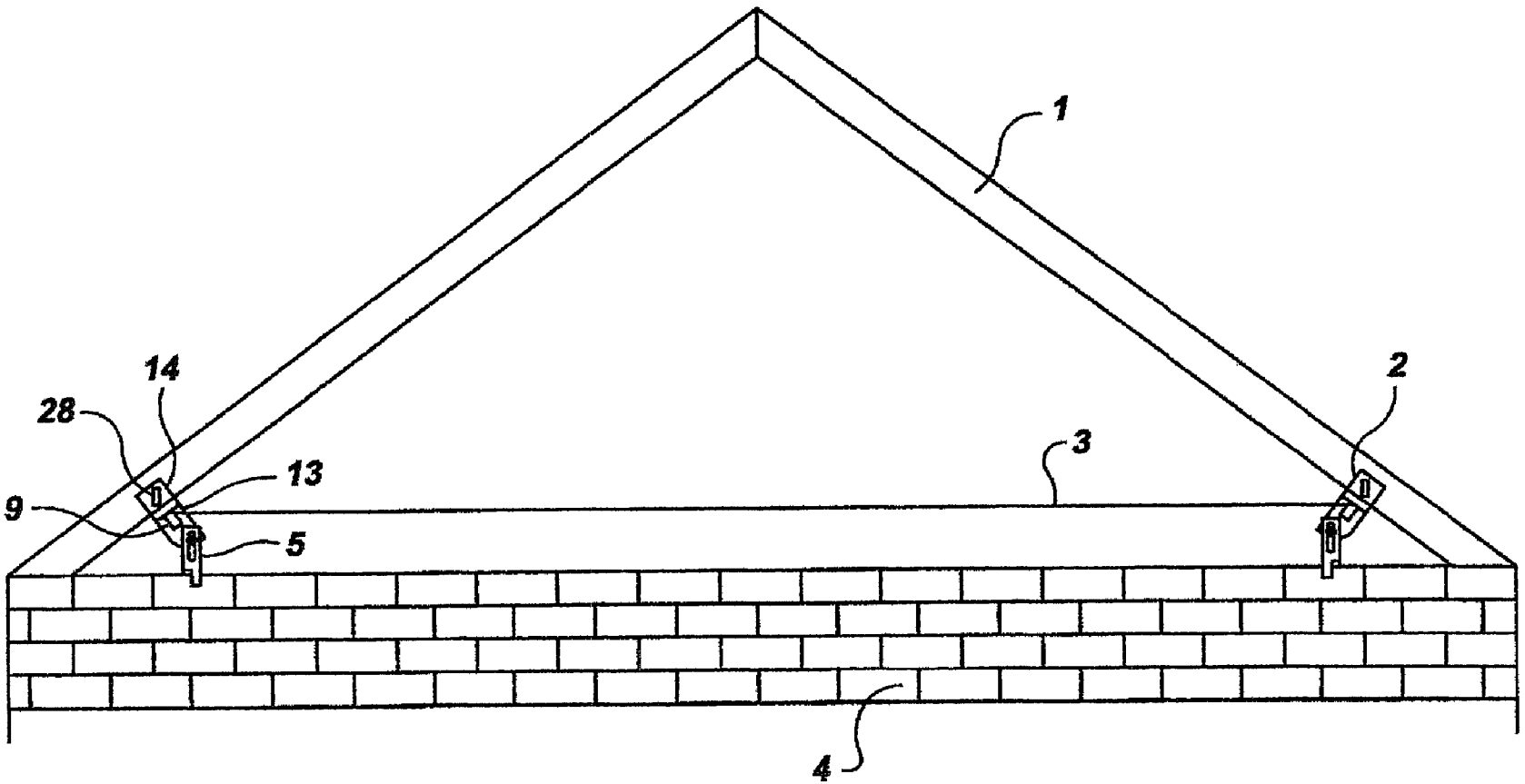
FIG. 1 is a contextual view of the adjustable gable end line puller described in the invention.

The present invention is an adjustable gable end line puller to aid in the construction of bricked-in-gables as depicted in FIG. 1. The invention includes a pair of adjustable clamps 2, attached to the fascia board under the roof line 1, with a mason's guide line 3 pulled taught between the adjustable clamps 2, and suspended above the wall of bricks 4 to ensure that the bricks and mortar are straight and level.

Figure 2:
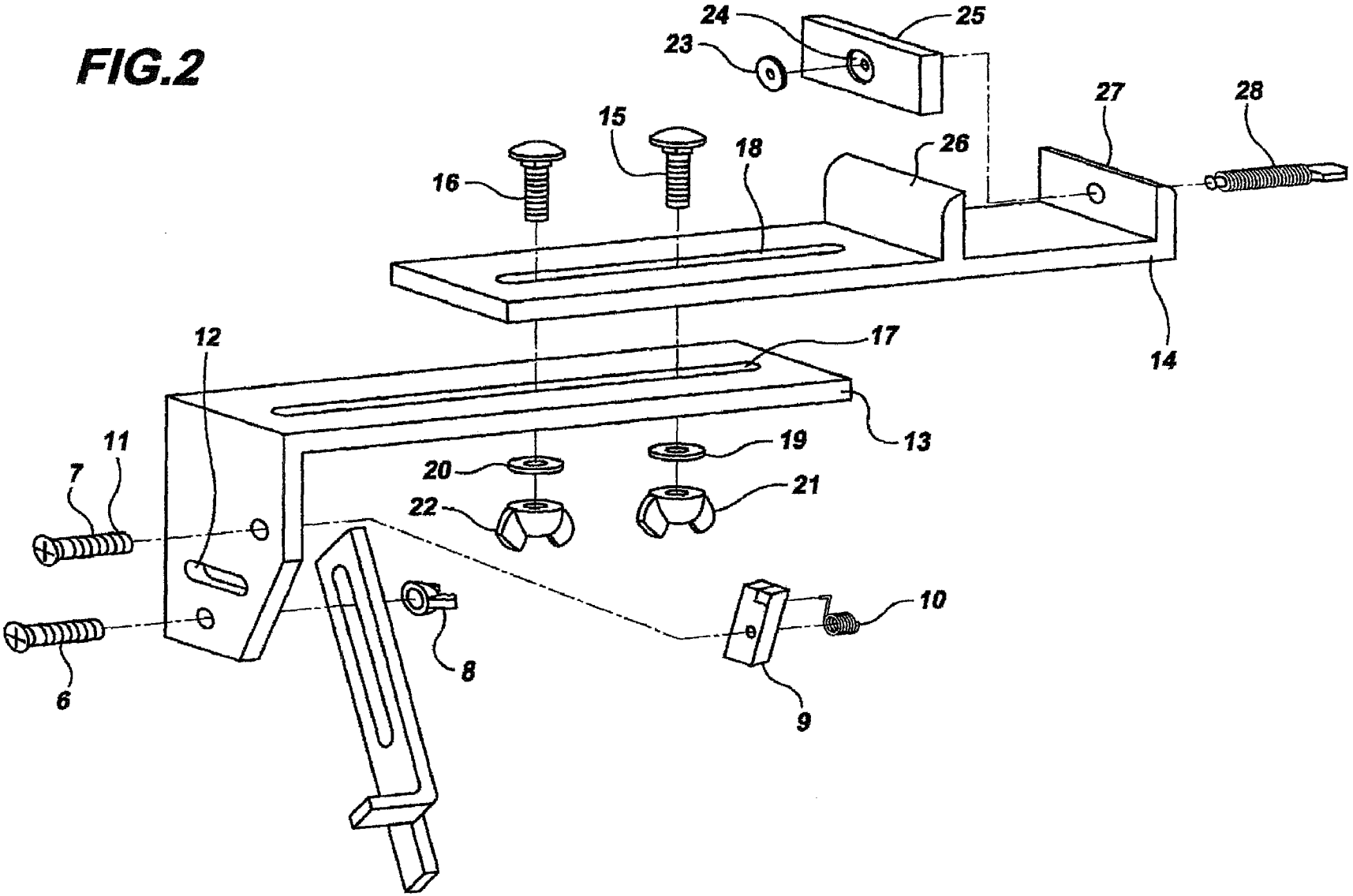
FIG. 2 is an exploded view of the adjustable gable end line puller described in the invention.

Now looking at FIG. 2, we see the adjustable clamp described in the present invention consisting of two horizontal members 13 and 14 and a gap setting member 5 that is slidable up and down and through a radius of arc. Horizontal member 13 is a piece of rectangular rigid material having an oval channel 17 and comprising a short leg and long leg affixed at a 90-degree angle to each other. Gap setting member 5 has an oval channel and is attached by bolt 6 and wingnut 8 through the oval channel 12 of the short leg of horizontal member 13. Gap setting member 5 may be slid up and down and the angle changed by loosening and then tightening bolt 6 and wingnut 8. In doing so, the user may accommodate for the size of the brick and the thickness of the mortar joint. Standard scales from A to K for oversized bricks and 0 through 9 for standard bricks are inscribed into gap setting member 5 and may be used to set standard brick and mortar joint thicknesses by adjusting gap setting member 5 at bolt 6 and wing nut 8.

Horizontal member 14 is a rectangular piece of rigid material with an oval channel 18 and one adjacently fixed fin 27 at one end of horizontal member 14 and another adjacently fixed fin 26 parallel to fixed fin 27. Thumb screw 28 passes through hole 24 and is rigidly fastened to moveable fin 25 by locking washer 23 but can still rotate clockwise or counter-clockwise. By turning thumb screw 28, the user moves moveable fin 25 through a horizontal plane to a suitable distance from fixed fin 26 allowing moveable fin 25 and fixed fin 26 to sandwich the fascia board tightly. It will be apparent that the combination of moveable fin 25, fixed fin 26, fixed fin 27, and thumb screw 28 forms the fastener for attaching the gable clamp to a fascia board.

Horizontal member 13 and 14 have oval channels 18 and 17, respectively, and are attached to one another by placing bolt 15 through the oval channel 18 and oval channel 17 and washer 19 and wing nut 21. Similarly, bolt 16 is placed through oval channel 18 and oval channel 17 and washer 20 and wing nut 22.

It will be appreciated that loosening and tightening bolts 15 and 16 will allow horizontal members 13 and 14 to slide in or out to accommodate various roof overhangs. In the present embodiment of the invention, these horizontal members are of dimensions sufficient to accommodate roof overhangs up to 16 inches, but larger clamps for larger overhangs could easily be fabricated following the teachings of the present invention.

Locking member 9 is pivotally attached to horizontal member 13 by means of bolt 7 and spring 10 having one of its ends pulled through bolt 7 at point 11. Locking member 9 can be loosened to allow the mason's line to be pulled between it and the underside of sliding member 13. The mason's line is then pulled through the oval channel of the short leg of slidable member 13. The mason's line can be held in place by pivoting locking member 9 up against the underside of sliding member 13 and tightening bolt 7. Thus, the combination of bolt 7, locking member 9, spring 10, and sliding member 13 forms the fastener for holding the mason's guideline to the gable clamp.

It will be apparent to one schooled in the relevant art of brick laying that one need only adjust the width between moveable fin 25 and fixed fin 26 once for the entire project. Likewise, after adjusting horizontal members 13 and 14 to the proper distance for the roof overhang, there is no need to re-adjust. Finally, once the proper setting for brick and mortar width is selected on gap setting member 5, that adjustment is completed for the project.

Once the three adjustments are set on both a clamp mounted on the fascia board of the right side of the gable end of the roof and on a clamp mounted on the fascia board of the left side of the gable end of the roof, one need only pull the mason's line taught between the two clamps, securing each end of the line by pivoting each clamp's locking member 9 up to the underside of horizontal member 13 and tightening each clamp's bolt 7.

As the pile of bricks gets higher, the brick mason need only loosen thumb screw 28 on the right and left-mounted clamps, move the clamps up the fascia board and tighten thumb screw 28 on the right and left-mounted clamps. No other adjustments are necessary to operate this ingenious invention.

Looking at FIG. 3, we see gap setting member 5 with oversize brick scale 29 and standard brick scale 30. Looking back at FIG. 2, we see that by loosening and tightening wing nut 8, the gap setting member can be moved up and down and through an appropriate arc to accommodate the brick size being used on the project. Adjacent stop fin 31 is used as the ending point for measuring the brick and mortar width.

Looking at FIG. 4, we see the left-mounted clamp attached to the left-most fascia board on the gable end of the roof. By loosening and tightening wing nut 8, we can move gap setting member 5 up and down and through the appropriate arc so that the width of the brick and mortar joint fit between the suspended mason's guide line 3 and the adjacent stop fin 31 of gap setting member 5. To ensure that the wall of bricks remains straight and even, the brick mason need only stack the next row of bricks and mortar so as to fit within the space defined by the guideline and the adjacent stop fin 31 of gap setting member 5.

If not otherwise stated herein, it is to be assumed that all patents, patent applications, patent publications and other publications (including web-based publications) mentioned and cited herein are hereby fully incorporated by reference herein as if set forth in their entirety herein.

Although illustrative embodiments of the present invention have been described herein with reference to the accompanying drawings, it is to be understood that the invention is not limited to those precise embodiments, and that various other changes and modifications may be affected therein by one skilled in the art without departing from the scope or spirit of the invention.

What is claimed is:

1. An adjustable gable end line puller comprising:

a mason's guideline;

a first and second gable clamp, each clamp including:

a fastener for attaching the clamp to a fascia board underneath a gable end of a roof;

a fastener for holding the mason's guideline to the clamp;

a gap setting member for maintaining an appropriate width for a brick and mortar joint, said gap setting member rotationally mounted to the clamp; and a first and second horizontal member, wherein the first and second horizontal members are capable of slidably extending and contracting from each other to accommodate a roof overhang; and wherein the first horizontal member has two parallel adjacently fixed fins with a moveable adjacent fin between the two fixed fins, said moveable adjacent fin capable of moving between the two fixed fins; and the second horizontal member has: a short leg and long leg affixed at a 90 degree angle to each other.

2. The adjustable gable end line puller as defined in claim 1, wherein standard scales from A to K for oversized bricks and 0 to 9 for standard bricks are inscribed into said gap setting member so that by rotating said gap setting member through an appropriate arc, an appropriate width for one brick and a mortar joint is defined by a distance between the suspended mason's guide line and the adjacent stop fin of said gap setting member.

3. The adjustable gable end line puller as defined in claim 1, wherein said fastener for attaching the clamp to the fascia board comprises: a thumb screw that is parallel to both the first and second horizontal members and travels through the fixed fin at the end of the first horizontal member and is pivotally attached to the moveable fin.

4. The adjustable gable end line puller as defined in claim 1 wherein said fastener for holding a mason's guide line to said clamp comprises: a locking member pivotally attached to the second horizontal member so that a mason's guideline can be held between the locking member and the second horizontal member.

5. A method for building a bricked-in-gable, comprising the steps of:

providing first and second gable clamps as described in claim 1;

attaching the first gable clamp to a left-most fascia board underneath the gable end of the roof;

attaching the second gable clamp to a right-most fascia board underneath the gable end of the roof;

slidably extending and contracting said horizontal members to accommodate the roof overhang;

rotating the gap setting member through an appropriate arc so that a distance between the suspended mason's guide line and the adjacent stop fin of said gap setting member is equivalent to the width of a brick and mortar joint;

fastening one end of the mason's guideline to the clamp attached to the left-most fascia board;

fastening the other end of the mason's guideline to the clamp attached to the right-most fascia board; and laying a row of bricks and mortar between the suspended mason's guideline and the adjacent stop fin of said gap setting member.

* * * * *